US012219998B2

(12) United States Patent
Wen

(10) Patent No.: US 12,219,998 B2
(45) Date of Patent: Feb. 11, 2025

(54) ATOMIZER AND ELECTRONIC ATOMIZATION DEVICE

(71) Applicant: SHENZHEN SMOORE TECHNOLOGY LIMITED, Shenzhen (CN)

(72) Inventor: Zhihua Wen, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 587 days.

(21) Appl. No.: 17/609,046

(22) PCT Filed: May 14, 2019

(86) PCT No.: PCT/CN2019/086741
§ 371 (c)(1),
(2) Date: Nov. 5, 2021

(87) PCT Pub. No.: WO2020/227910
PCT Pub. Date: Nov. 19, 2020

(65) Prior Publication Data

US 2022/0192271 A1 Jun. 23, 2022

(51) Int. Cl.
*A24F 40/48* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/46* (2020.01);
(Continued)

(58) Field of Classification Search
CPC ..... A24F 40/485; A24F 40/48; A24F 40/10; A24F 40/90; A24F 40/46; A24F 40/42; A24F 40/51; A24F 40/60
(Continued)

(56) References Cited

U.S. PATENT DOCUMENTS 3,661,323 A * 5/1972 Farris ..... F24F 8/00 261/DIG. 88
6,706,988 B1 * 3/2004 Helf ..... A61L 9/14 200/332
(Continued)

FOREIGN PATENT DOCUMENTS

CN 103002759 A 3/2013
CN 103932401 A 7/2014
(Continued)

OTHER PUBLICATIONS

First Office Action for Chinese Application No. 201910398965.3 mailed Dec. 27, 2023.
(Continued)

*Primary Examiner* — Harshad C Patel
(74) *Attorney, Agent, or Firm* — Dorsey & Whitney LLP

(57) ABSTRACT

An example atomizer includes: a housing provided with a liquid storage chamber for storing liquid and a liquid outlet channel communicated with the liquid storage chamber; an atomization component mounted on the housing, the liquid storage chamber being capable of supplying liquid to the atomization component through the liquid outlet channel; and an on-off component connected to the housing and having a first station and a second station. When the on-off component is located at the first station, the on-off component blocks the liquid outlet channel. When the on-off component is located at the second station, the on-off component opens the liquid outlet channel.

18 Claims, 10 Drawing Sheets

(51) Int. Cl.

| | |
|---|---|
| ***A24F 40/42*** | (2020.01) |
| ***A24F 40/46*** | (2020.01) |
| ***A24F 40/485*** | (2020.01) |
| ***A24F 40/51*** | (2020.01) |
| ***A24F 40/60*** | (2020.01) |
| ***A24F 40/90*** | (2020.01) |

(52) U.S. Cl.
CPC ..... *A24F 40/51* (2020.01); *A24F 40/60* (2020.01); *A24F 40/90* (2020.01)

(58) Field of Classification Search
USPC ..... 131/329
See application file for complete search history.

(56) References Cited

U.S. PATENT DOCUMENTS

| | | | | |
|---|---|---|---|---|
| 7,455,245 | B2 * | 11/2008 | Sipinski | A61L 9/14 239/326 |
| 8,578,942 | B2 * | 11/2013 | Schennum | A61M 15/06 131/270 |
| 8,950,395 | B2 * | 2/2015 | Schennum | B65D 83/54 128/200.23 |
| 9,848,642 | B2 * | 12/2017 | Schennum | A24F 42/60 |
| 9,861,127 | B2 * | 1/2018 | Liu | A24F 40/60 |
| 10,039,321 | B2 * | 8/2018 | Verleur | A24F 40/44 |
| 10,279,934 | B2 * | 5/2019 | Christensen | B65B 3/18 |
| 11,969,014 | B2 * | 4/2024 | Qiu | A24F 40/51 |
| 2011/0290268 | A1 | 12/2011 | Schennum | |
| 2012/0227735 | A1 * | 9/2012 | Abate | A61M 15/0015 128/200.14 |
| 2014/0174458 | A1 | 6/2014 | Katz | |
| 2014/0202472 | A1 | 7/2014 | Levitz et al. | |
| 2015/0090256 | A1 | 4/2015 | Chung | |
| 2015/0216234 | A1 | 8/2015 | Chung | |
| 2020/0163381 | A1 * | 5/2020 | Qiu | A24F 40/46 |
| 2022/0192271 | A1 * | 6/2022 | Wen | A24F 40/40 |

FOREIGN PATENT DOCUMENTS

| | | | |
|---|---|---|---|
| CN | 104544570 | A | 4/2015 |
| CN | 204232296 | U | 4/2015 |
| CN | 104839893 | A | 8/2015 |
| CN | 105212278 | A | 1/2016 |
| CN | 106455696 | A | 2/2017 |
| CN | 106723379 | A | 5/2017 |
| CN | 108308715 | A | 7/2018 |
| CN | 108576941 | A | 9/2018 |
| CN | 207940347 | U | 10/2018 |
| CN | 109480338 | A | 3/2019 |
| CN | 109619700 | A | 4/2019 |
| CN | 208798692 | U | 4/2019 |
| CN | 110101120 | A | 8/2019 |
| CN | 110101121 | A | 8/2019 |
| CN | 210492612 | U | 5/2020 |
| CN | 210841569 | U | 6/2020 |
| JP | 2007029771 | A | 2/2007 |
| JP | 2013526381 | A | 6/2013 |
| JP | 2018174928 | A | 11/2018 |
| JP | 2020516270 | A | 6/2020 |
| KR | 101454125 | B1 | 10/2014 |
| RU | 2681208 | C2 | 3/2019 |
| WO | 2018039876 | A1 | 3/2018 |
| WO | 2018188616 | A1 | 10/2018 |

OTHER PUBLICATIONS

First Office Action for Chinese Application No. 201910399147.5 mailed Nov. 10, 2023.
Office Action for Japanese Patent Application No. 2021-567968 mailed Feb. 7, 2023.
Office Action for Russian Application No. 2021135546 mailed May 30, 2022.
Written Opinion from International Application No. PCT/CN2019/086741 mailed Jan. 13, 2020.
Decision to Grant of Russian Patent Application No. 2021135546/03 mailed Sep. 14, 2022.
Extended European Search Report for European Application No. 19928583.4 mailed Nov. 16, 2022.
International Search Report from International Application No. PCT/CN2019/086741 mailed Jan. 13, 2021.
Communication Pursuant to Article 94(3) for European Application No. 19928583.4 mailed Apr. 18, 2024.
Notice of Allowance for Chinese Application No. 201910398965.3 mailed May 30, 2024.
Notice of Allowance for Chinese Application No. 201910399147.5 mailed Jul. 12, 2024.

* cited by examiner

ATOMIZER AND ELECTRONIC ATOMIZATION DEVICE

CROSS-REFERENCE TO RELATED APPLICATION

This application is a U.S. national stage of PCT Patent Application No. PCT/CN2019/086741, entitled "ATOMIZER AND ELECTRONIC ATOMIZATION DEVICE", filed on May 14, 2019, the contents of which are incorporated by reference herein in their entirety.

TECHNICAL FIELD

The present disclosure relates to the field of electronic atomization technologies, and in particular, to an atomizer and an electronic atomization device including the atomizer.

BACKGROUND

An electronic atomization device can atomize liquid such as an aerosol-forming matrix, and smoke formed after the atomization of the aerosol-forming matrix does not contain harmful ingredients such as tar and suspended particles, so that the electronic atomization device can be used as an alternative to cigarettes. For a conventional electronic atomization device, oil leakage occurs in the electronic atomization device when suction is stopped.

SUMMARY

One technical problem solved in the present disclosure is how to prevent leakage of an atomizer.

An atomizer of an electronic atomization device, including:

a housing provided with a liquid storage chamber for storing liquid and a liquid outlet channel communicated with the liquid storage chamber;

an atomization component mounted on the housing, the liquid storage chamber being capable of supplying liquid to the atomization component through the liquid outlet channel; and an on-off component connected to the housing and having a first station and a second station;

when the on-off component is located at the first station, the on-off component blocking the liquid outlet channel; and when the on-off component is located at the second station, the on-off component opening the liquid outlet channel An electronic atomization device, including a battery component, a sensing component and the atomizer according to any one of the foregoing, the battery component being connected to the atomizer.

BRIEF DESCRIPTION OF THE DRAWINGS

In order to better describe and illustrate embodiments and/or examples of those inventions disclosed herein, reference may be made to one or more accompanying drawings. Additional details or examples used to describe the accompanying drawings should not be considered as limitations on the scope of any of the disclosed inventions, the presently described embodiments and/or examples, and the presently understood best mode of these inventions.

DETAILED DESCRIPTION OF THE EMBODIMENTS

Figure 1:
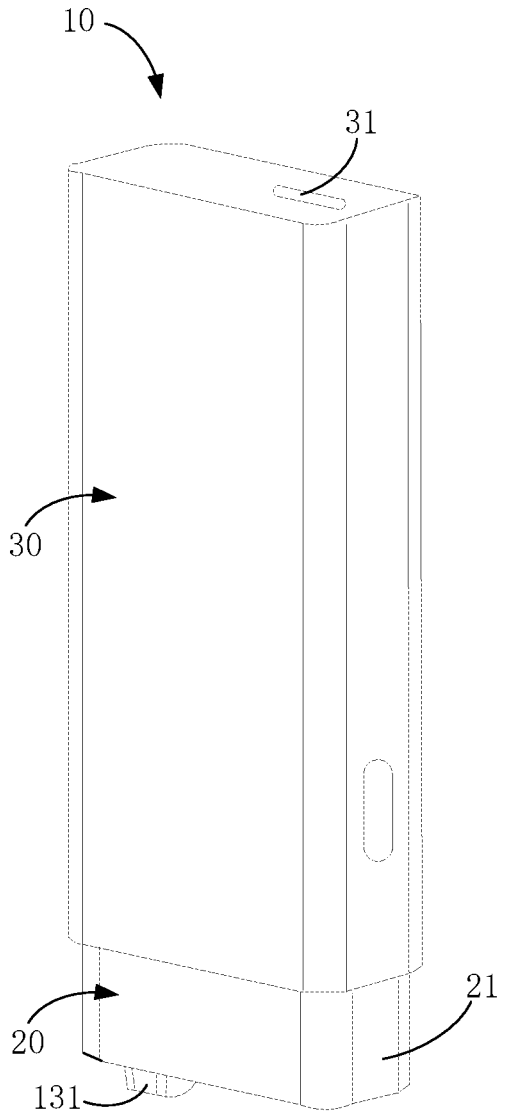
FIG. 1 is a schematic diagram of an overall assembly structure of an electronic atomization device according to an embodiment.
Figure 2:
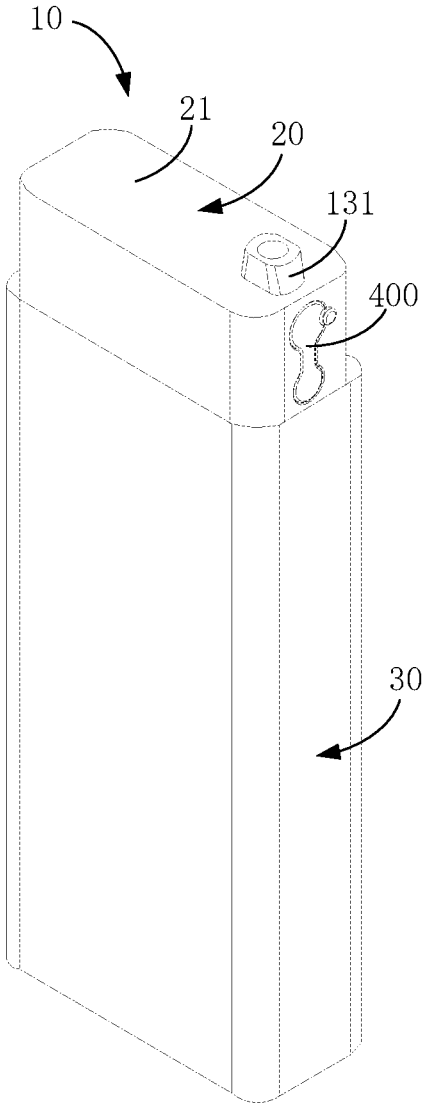
FIG. 2 is a schematic diagram of the overall assembly structure in FIG. 1 from another perspective.
Figure 3:
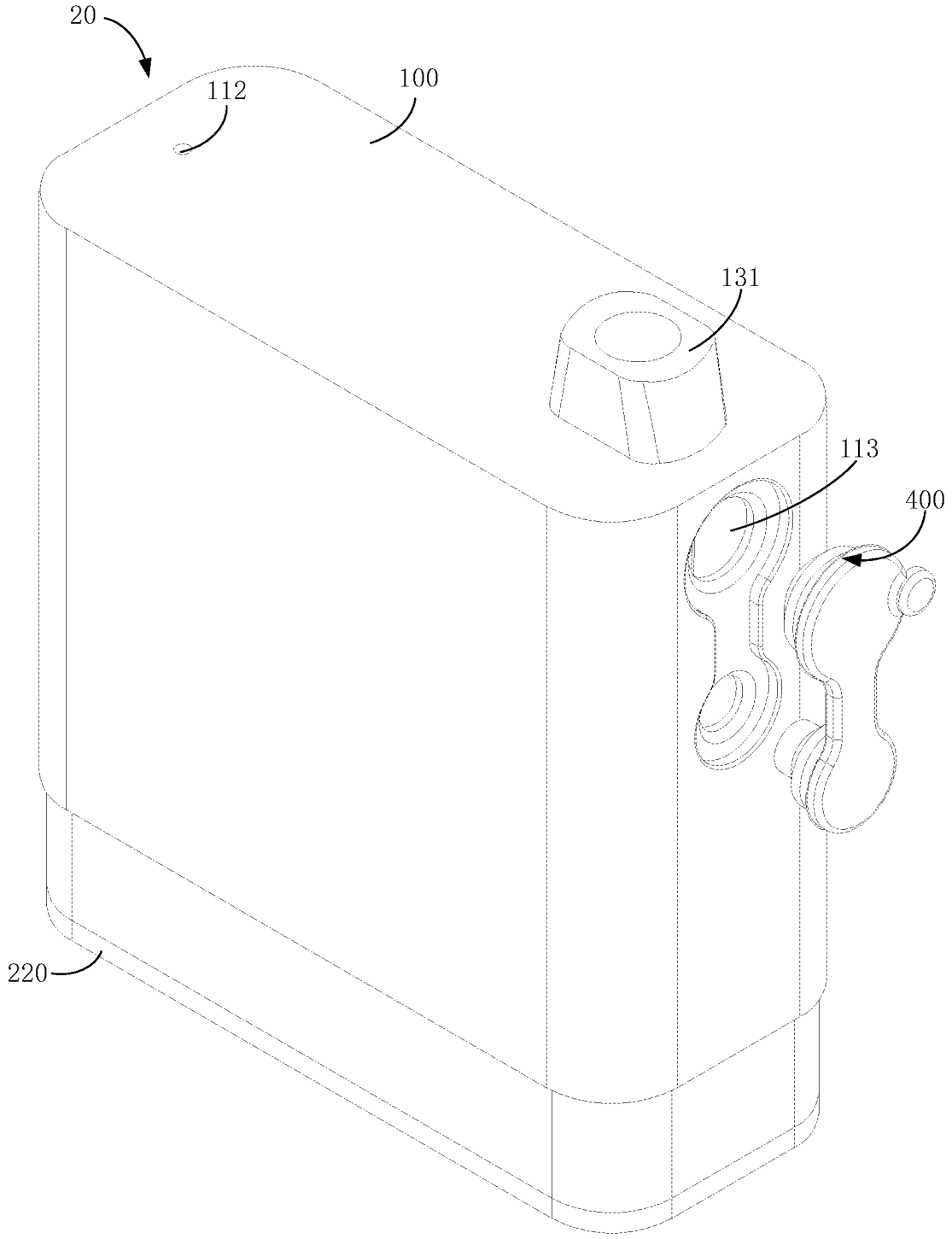
FIG. 3 is a schematic diagram of an overall assembly structure of the atomizer in FIG. 1.
Figure 4:
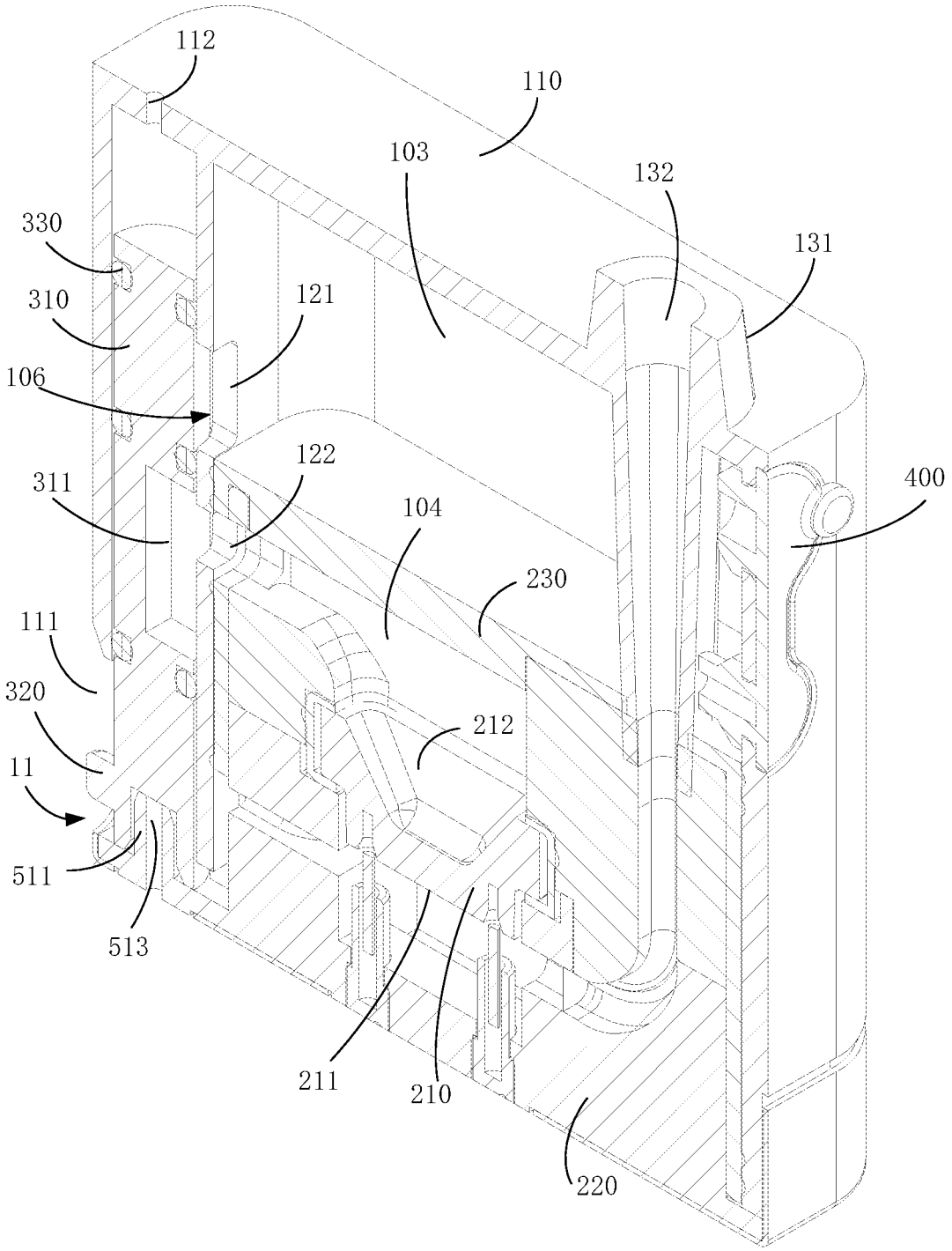
FIG. 4 is a schematic diagram of a three-dimensional sectional structure when an on-off component in FIG. 3 is located at a first station.

For easy understanding of the present disclosure, a more comprehensive description of the present disclosure is given below with reference to the accompanying drawings. Preferred implementations of the present disclosure are given in the accompanying drawings. However, the present disclosure may be implemented in many different forms and is not limited to the implementations described herein. On the contrary, these implementations are provided to understand the disclosed content of the present disclosure more thoroughly and comprehensively.

It is to be noted that when an element is referred to as being "fixed to" another element, the element may be directly on the other element or an intermediate element may exist. When an element is referred to as being "connected to" another element, the element may be directly connected to the other element or an intermediate element may co-exist. The terms "inner", "outer", "left", "right" and similar expressions used herein are for illustrative purposes only, and do not represent unique implementations.

Referring to FIG. 1 to FIG. 6 and FIG. 9, an electronic atomization device 10 according to an embodiment of the present disclosure may be configured to atomize liquid represented by an aerosol-forming matrix. The electronic atomization device 10 includes an atomizer 20, a battery component 30 and a sensing component 500. The atomizer 20 and the battery component 30 may realize a detachable connection. The atomizer 20 includes an atomization mechanism 21 and an on-off component 300. The atomization mechanism 21 includes a housing 100 and an atomization component 200. The electronic atomization device 10 has a liquid suction chamber 104 and a liquid storage chamber 103. The liquid storage chamber 103 is configured to store liquid. The housing 100 is provided with a liquid outlet channel 106 communicated with the liquid storage chamber 103. The liquid storage chamber 103 may inject liquid into the liquid suction chamber 104 through the liquid outlet channel 106. The atomization component 200 is configured to atomize the liquid in the liquid suction chamber 104. The on-off component 300 is connected to the housing 100 and has a first station 11 and a second station 12. When the on-off component 300 is located at the first station 11, the on-off component 300 blocks the liquid outlet channel 106, the liquid storage chamber 103 and the liquid suction chamber 104 are isolated from each other, the liquid storage chamber 103 stops supplying liquid to the liquid suction chamber 104, and the sensing component 500 stops controlling the battery component 30 to heat the atomization component 200 to atomize the liquid in the liquid suction chamber 104, so that a user cannot suck the electronic atomization device 10. When the on-off component 300 is located at the second station 12, the on-off component 300 opens the liquid outlet channel 106, the liquid storage chamber 103 and the liquid suction chamber 104 are communicated with each other, the liquid storage chamber 103 can supply liquid to the liquid suction chamber 104, and the sensing component 500 controls the battery component 30 to heat the atomization component 200 to atomize the liquid in the liquid suction chamber 104, so that the user can suck the electronic atomization device 10.

Certainly, in other embodiments, the liquid suction chamber 104 may not be provided, and the liquid in the liquid storage chamber 103 is directly supplied to the atomization component 200 through the liquid outlet channel 106. That is, the atomization component 200 sucks liquid directly from an end opening of the liquid outlet channel 106 through capillary action and atomizes the liquid.

Referring to FIG. 3 and FIG. 4, FIG. 7 and FIG. 8, in some embodiments, the housing 100 includes a body portion 110, an isolation portion 120 and a nozzle portion 130. The body portion 110 defines a large accommodating chamber. The body portion 110 is roughly shaped like a cuboid with an opening. The isolation portion 120 is connected to the body portion 110 and located in the accommodating chamber. The isolation portion 120 and the body portion 110 define a first chamber 101 and a second chamber 102. That is, the isolation portion 120 separates the accommodating chamber into the first chamber 101 and the second chamber 102. The nozzle portion 130 is substantially in a shape of a tube. The nozzle portion 130 is connected to the body portion 110. A part of the nozzle portion 130 protrudes a set length from an outer surface of the body portion 110. The part of the nozzle portion 130 protruding from the outer surface of the body portion 110 forms a nozzle 131 for a user to suck. The other part of the nozzle portion 130 is located in the first chamber 101. The part of the nozzle portion 130 located in the first chamber 101 may be inserted into the atomization component 200.

Referring to FIG. 3 and FIG. 4, FIG. 6, FIG. 9 and FIG. 10, the atomization component 200 includes an atomizing core 210, a base 220, a top cover 230 and a sealing sleeve 240. The top cover 230 is provided with a cavity. A part of the base 220 is inserted into the cavity, and the other part of the base 220 is located outside the cavity and can close an opening of the cavity. At the same time, the other part of the base 220 can also close an opening of the accommodating chamber enclosed by the body portion 110. The atomizing core 210 is entirely located in the cavity of the top cover 230, and is interposed between the top cover 230 and the base 220. The atomizing core 210 and the top cover 230 jointly define the liquid suction chamber 104. That is, the atomizing core 210 can define a partial boundary of the liquid suction chamber 104. For example, the base 220 is provided with a first step surface 221, the top cover 230 is provided with a second step surface 231 arranged opposite to the first step surface 221, and the atomizing core 210 is sandwiched between the first step surface 221 and the second step surface 231. The mounting accuracy and efficiency of the atomizing core 210 can be improved by a limiting effect of the first step surface 221 and the second step surface 231 on the atomizing core 210.

The top cover 230 is received in the first chamber 101. A remaining part of the first chamber 101 except a space for receiving the top cover 230 forms the liquid storage chamber 103. That is, the top cover 230, the isolation portion 120 and the body portion 110 jointly define the liquid storage chamber 103. The atomizer 20 further includes a cap 400. The body portion 110 is provided with a liquid injection hole 113 at a position close to the nozzle portion 130. The liquid injection hole 113 can communicate the outside with the liquid storage chamber 103. When an amount of liquid stored in the liquid storage chamber 103 is lower than a set value, the liquid may be injected into the liquid storage chamber 103 through the liquid injection hole 113, so as to replenish an oil storage volume of the liquid storage chamber 103. The cap 400 is mounted on the body portion 110. After oil injection is completed, the cap 400 is also engaged with the liquid injection hole 113 to block the liquid injection hole 113, so as to prevent leakage of the liquid from the liquid injection hole 113 and also prevent incursion of dust and other impurities into the liquid in the liquid storage chamber 103 through the liquid injection hole 113.

Figure 6:
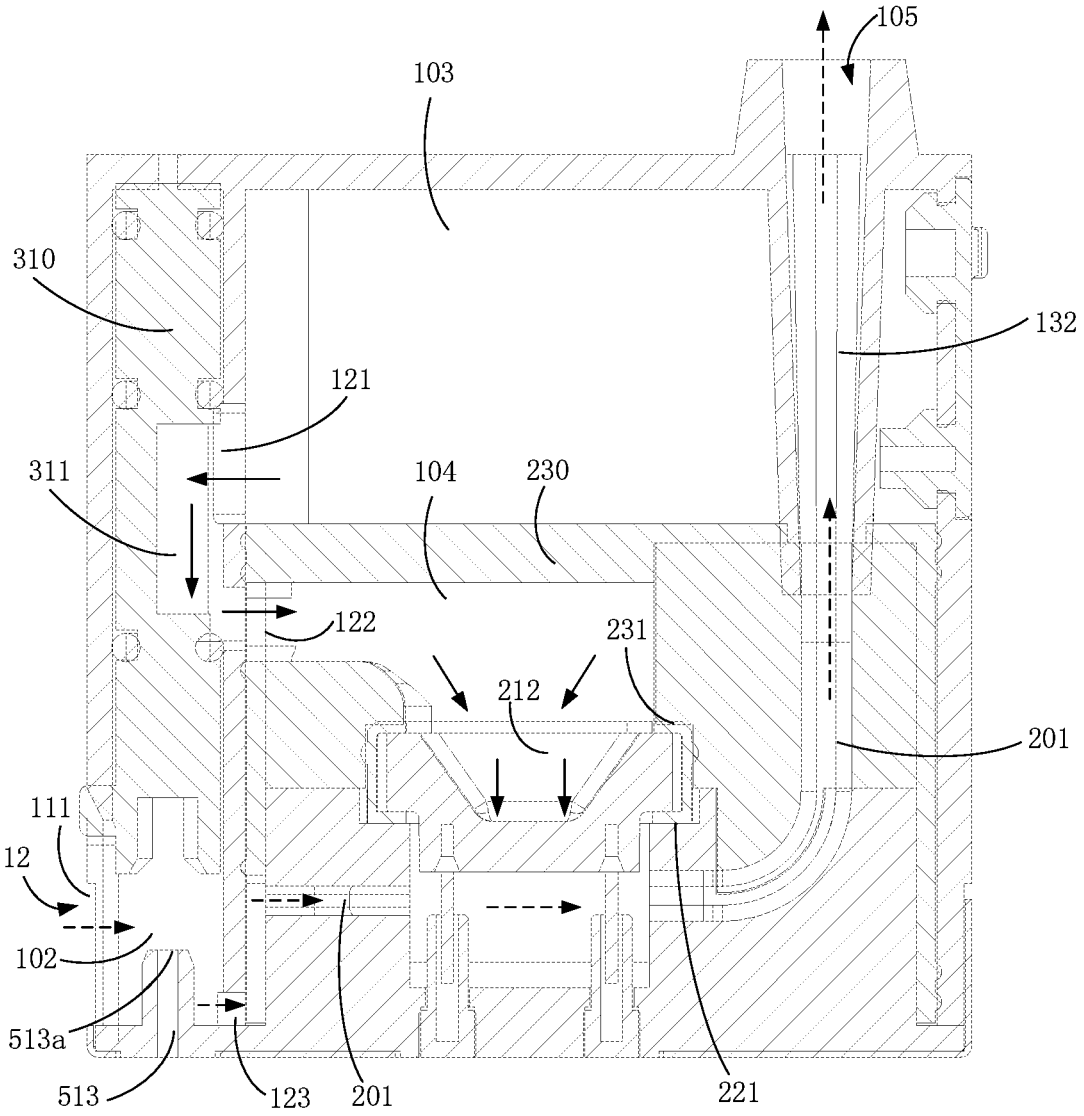
FIG. 6 is a schematic diagram of a planar sectional structure when the on-off component in FIG. 3 is located at a second station.
Figure 7:
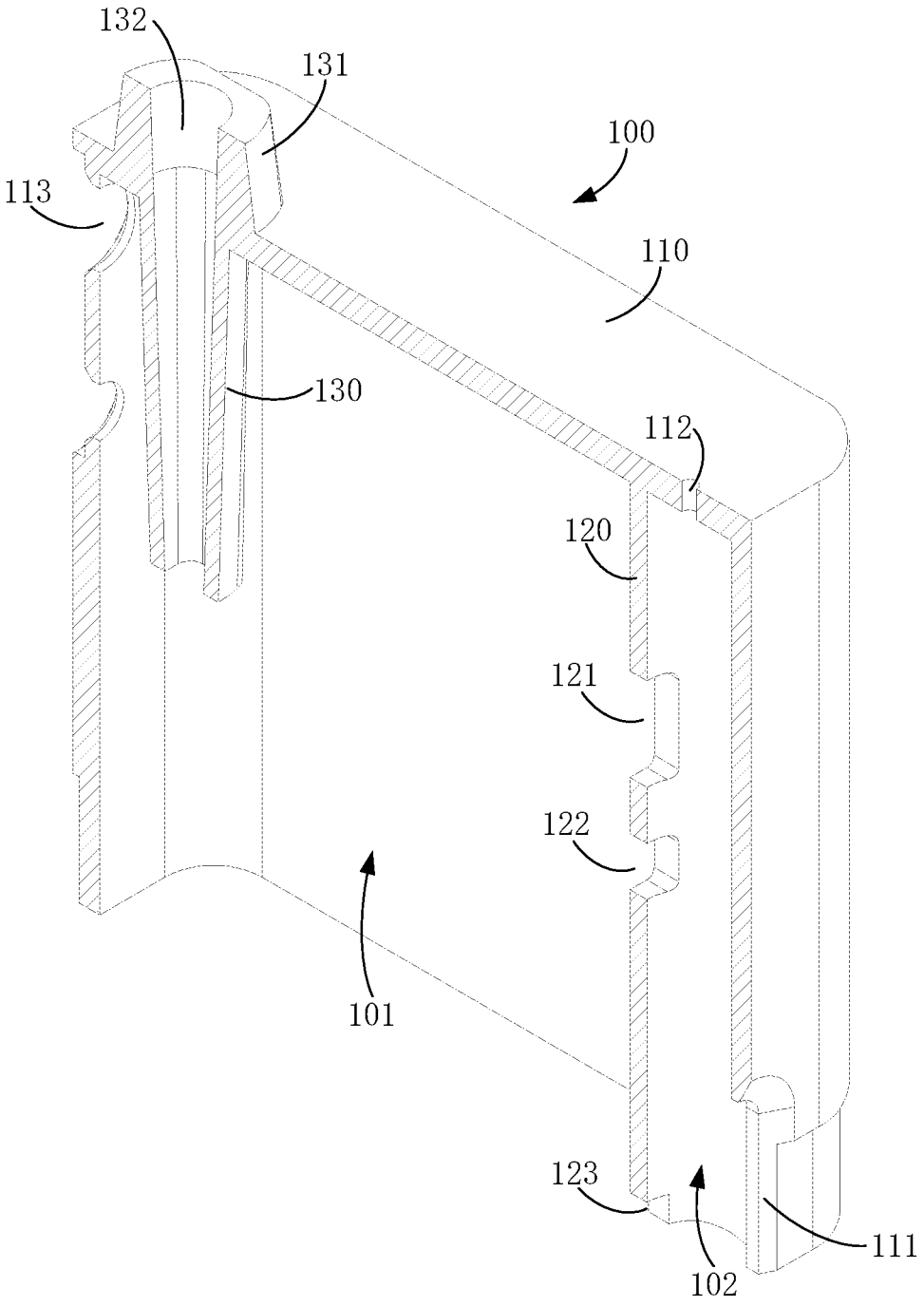
FIG. 7 is a schematic diagram of a three-dimensional sectional structure of a housing in FIG. 3.
Figure 8:
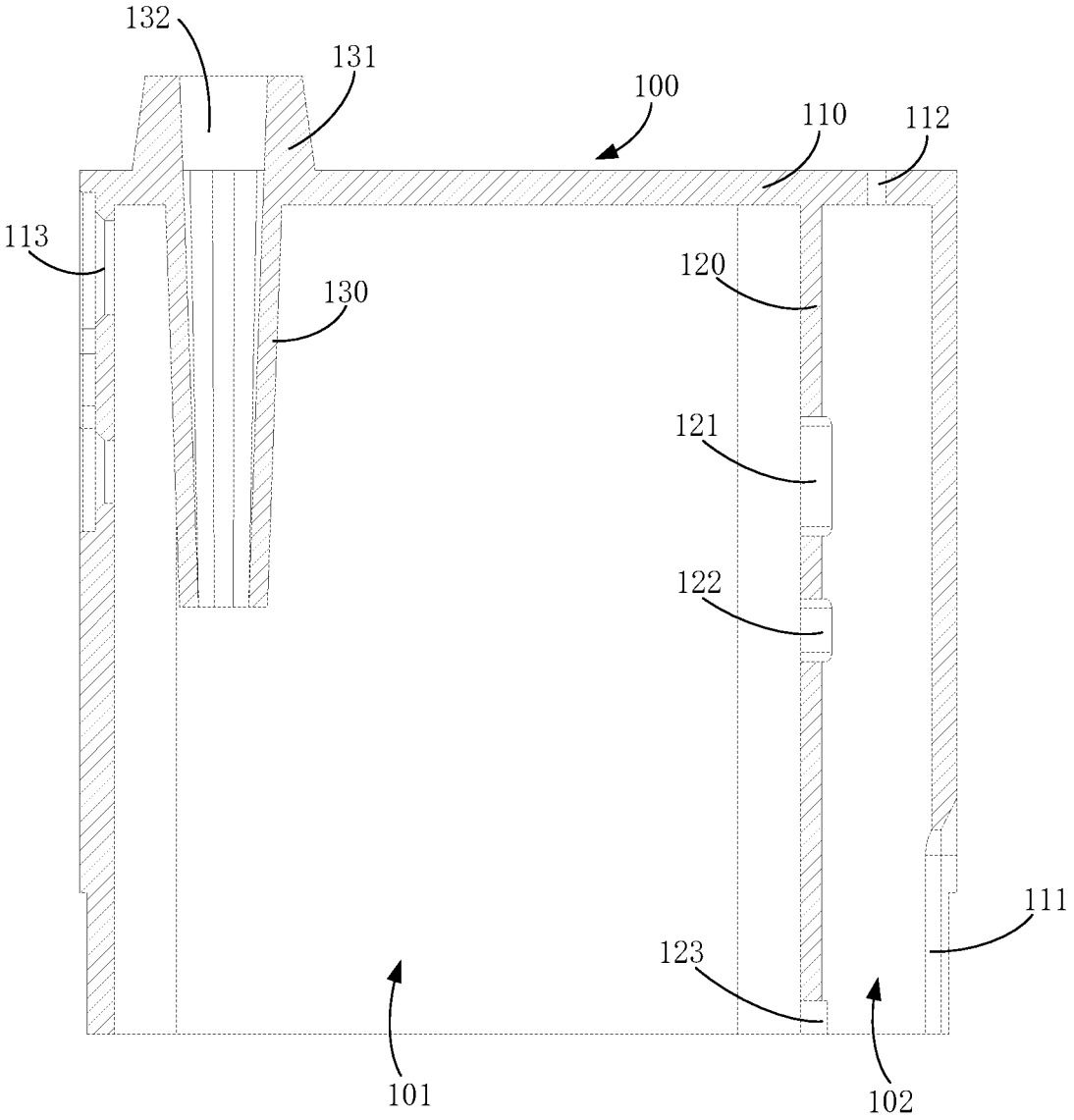
FIG. 8 is a schematic diagram of a planar sectional structure of the housing in FIG. 3.

Referring to FIG. 6, a first airflow channel 201 is provided on the top cover 230 and the base 220, and the nozzle portion 130 of the housing 100 is provided with a second airflow channel 132. For example, the nozzle portion 130 is inserted into an opening of the first airflow channel 201 in the top cover 230, so as to realize mutual communication between the first airflow channel 201 and the second airflow channel 132. The body portion 110 is provided with an air inlet 111 communicating the outside with the second chamber 102. The isolation portion 120 is provided with an air vent 123 communicating the first airflow channel 201 with the second chamber 102. The air inlet 111, the second chamber 102, the air vent 123, the first airflow channel 201 and the second airflow channel 132 jointly form a suction channel 105 for air circulation. When the user sucks at the nozzle, an external airflow sequentially passes through the air inlet 111, the second chamber 102, the air vent 123, the first airflow channel 201 and the second airflow channel 132 so as to be sucked by the user (the dotted arrows in FIG. 6 indicate a flow direction of the airflow).

Figure 5:
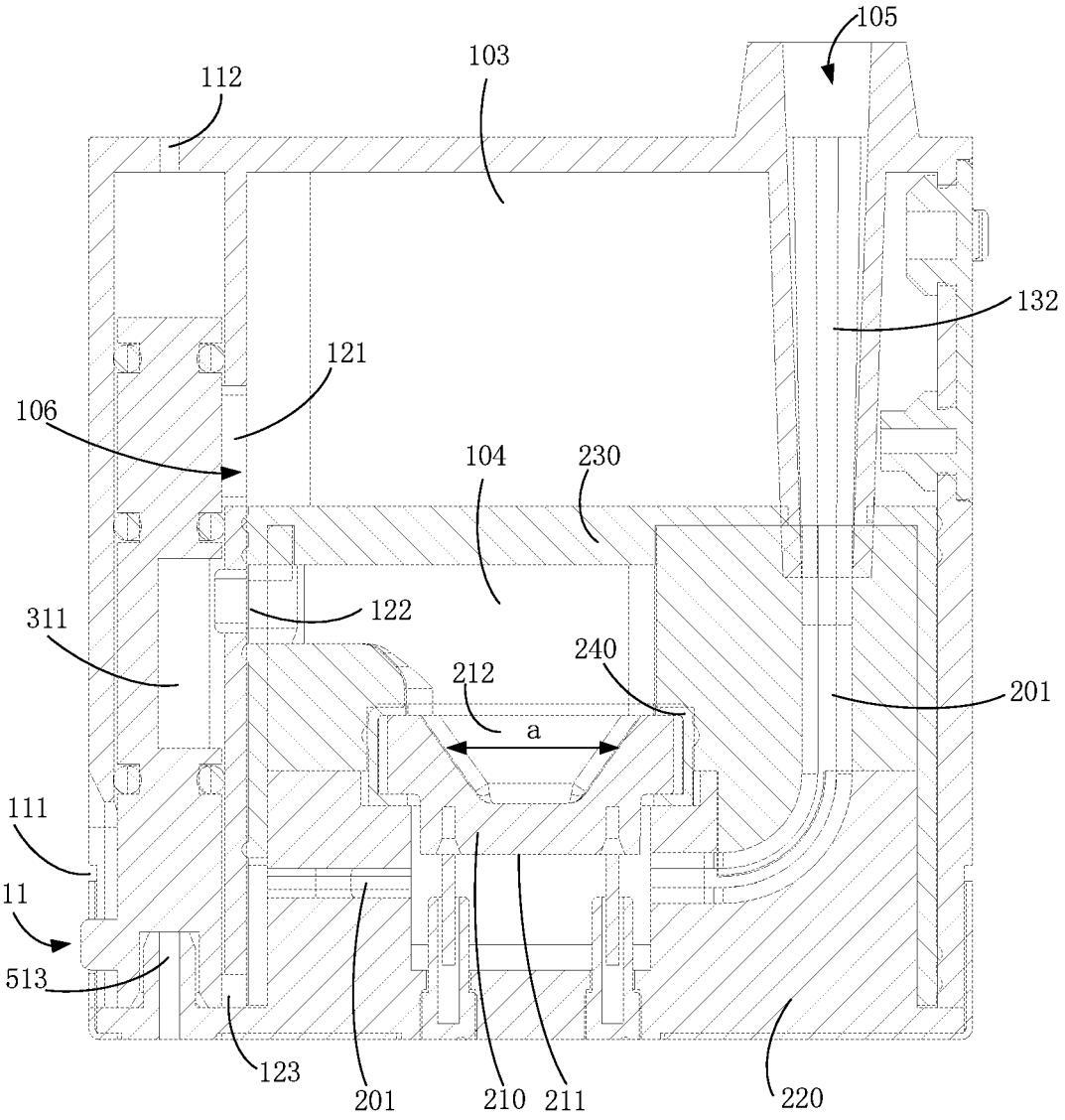
FIG. 5 is a schematic diagram of a planar sectional structure when the on-off component in FIG. 3 is located at the first station.
Figure 10:
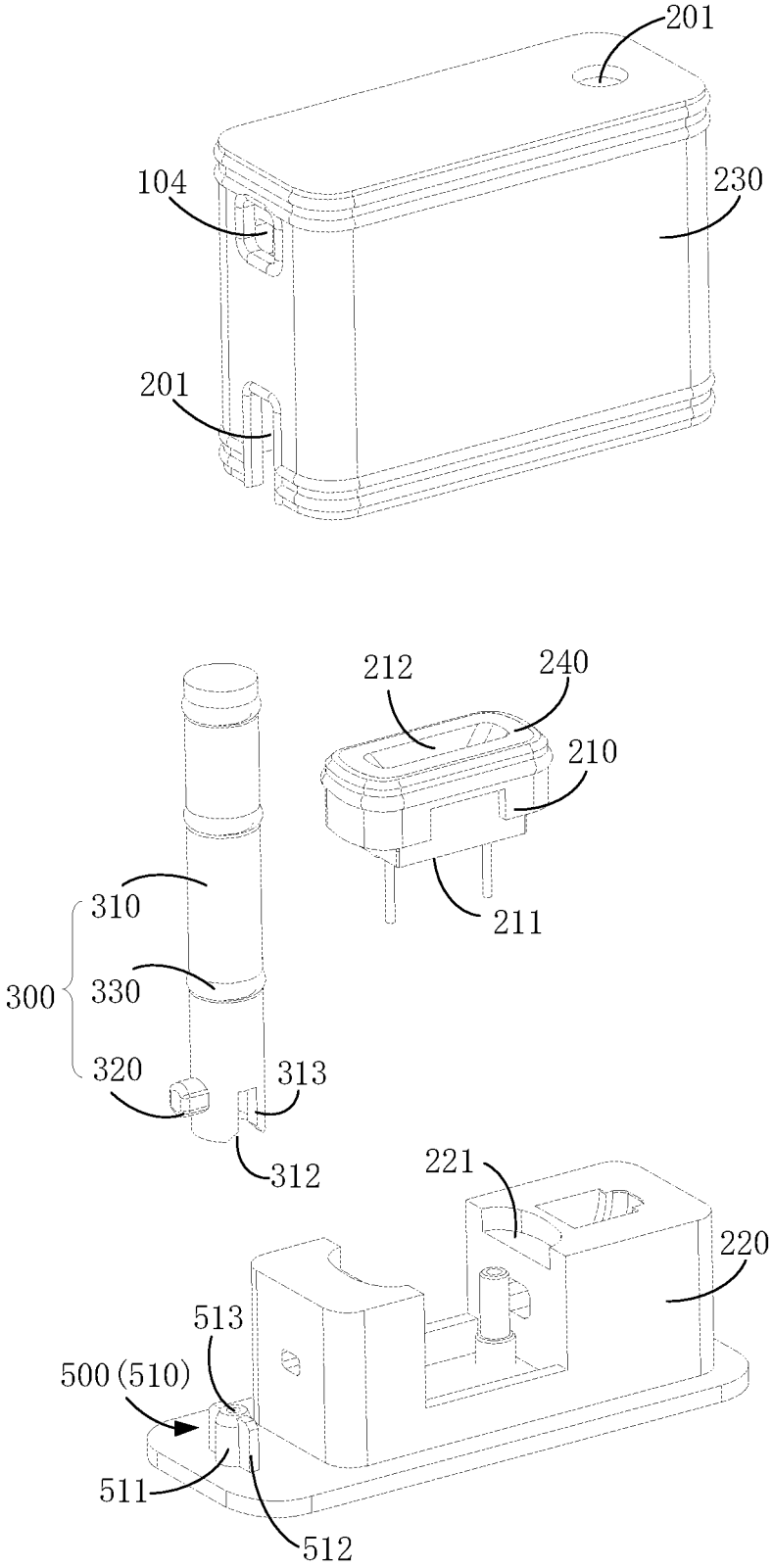
FIG. 10 is a schematic diagram of a breakdown structure of FIG. 9.

Referring to FIG. 5, FIG. 6 and FIG. 10, the atomizing core 210 may be made of a porous ceramic material, and the atomizing core 210 is connected to the battery component 30 through an electrode. The atomizing core 210 has an atomizing surface 211. The first airflow channel 201 flows through the atomizing surface 211. Under capillary action of the atomizing core 210, the liquid in the liquid suction chamber 104 is sucked to the atomizing surface 211, the battery component 30 is heated to the atomizing surface 211 through the electrode, and the liquid is atomized on the atomizing surface 211 to form smoke. When the user sucks at the nozzle, air entering from the air inlet 111, the second chamber 102 and the air vent 123 into the first airflow channel 201 carries the smoke and is sucked by the user through the second airflow channel 132.

The sealing sleeve 240 may be a silicon gel sleeve or the like. That is, the sealing sleeve 240 is made of a silicon gel material. The atomizing core 210 is sleeved with the silicon gel sleeve and the silicon gel sleeve abuts between the first step surface 221 and the second step surface 231. The silicon gel sleeve may prevent leakage of the liquid in the liquid suction chamber 104 from gaps between the atomizing core 210 and the top cover 230 and between the atomizing core 210 and the base 220. At the same time, the silicon gel sleeve may protect the atomizing core 210 and insulate heat, prevent the transfer of heat from the atomizing core 210 to the body portion 110 of the housing 100, so as to improve the utilization rate of energy, and at the same time, prevent the discomfort of the user due to the heat transferred to the body portion 110.

In some embodiments, the atomizing core 210 defines a surface of the boundary of the liquid suction chamber 104 to be recessed toward the atomizing surface 211 to form a buffer chamber 212. The buffer chamber 212 is communicated with the liquid suction chamber 104. The buffer chamber 212 may be configured to buffer the liquid in the liquid suction chamber 104. Due to the arrangement of the buffer chamber 212, a bottom wall of the buffer chamber 212 is relatively closer to the atomizing surface 211, so that the liquid can be transported to the atomizing surface 211 more quickly, so as to ensure that the atomizing surface 211 contains sufficient liquid and prevent dry burning due to insufficient liquid suction. A size a of a cross section of the buffer chamber 212 decreases along a direction of the liquid suction chamber 104 pointing to the first airflow channel 201, that is, a top-down direction, which may play a role in reasonably balancing liquid suction, so that the atomizing surface 211 can suck an appropriate amount of liquid, and prevent the leakage caused by too much liquid and dry burning caused by insufficient liquid on the atomizing surface 211.

Referring to FIG. 4 to FIG. 8, in some embodiments, a first through hole 121 and a second through hole 122 are spaced apart on the isolation portion 120. The first through hole 121 and the second through hole 122 jointly form the liquid outlet channel 106. The first through hole 121 communicates the liquid storage chamber 103 with the second chamber 102. The second through hole 122 communicates the liquid suction chamber 104 with the second chamber 102. The second chamber 102 may be a cylindrical chamber. The on-off component 300 includes a slide bar 310, a sealing member 330 and a handle 320. The slide bar 310 is slidably arranged in the second chamber 102. An outer surface of the slide bar 310 is radially recessed to form a communicating chamber 311. When the slide bar 310 slides to the first station 11, the outer surface of the slide bar 310 can effectively block the first through hole 121 on the isolation portion 120, so as to block the entire liquid outlet channel 106 and prevent the liquid in the liquid storage chamber 103 from flowing out of the first through hole 121. When the liquid cannot flow out of the first through hole 121, the liquid in the liquid storage chamber 103 cannot enter the liquid suction chamber 104. When the slide bar 310 slides upwards from the first station 11 to the second station 12, since the communicating chamber 311 is formed by the recessing of the outer surface of the slide bar 310, the slide bar 310 cannot block the first through hole 121, and the first through hole 121 and the communicating chamber 311 are communicated with each other. At the same time, the second through hole 122 is also communicated with the communicating chamber 311. In this case, the liquid in the liquid storage chamber 103 can enter the liquid suction chamber 104 successively through the first through hole 121, the cavity communicating chamber 311 and the second through hole 122 (the solid arrows in FIG. 6 indicate a flow direction of the liquid).

The sealing member 330 may be an O-ring or the like. The sealing member 330 is embedded into the slide bar 310 and capable of abutting between the slide bar 310 and an inner wall of the second chamber 102, to prevent leakage of liquid and air from a gap between the slide bar 310 and the inner wall of the second chamber 102. The handle 320 is connected to the slide bar 310. The user may apply a force to the handle 320, so as to drive the slide bar 310 to slide up and down in the second chamber 102. The handle 320 passes through the air inlet 111. The air inlet 111 provides an avoidance space for motion of the handle 320. When the slide bar 310 is located at the first station 11, the slide bar 310 may block the air inlet 111 completely. When the user sucks from the nozzle, external air cannot enter through the air inlet 111, so that the suction channel 105 cannot suck air from the outside. In other embodiments, the on-off component 300 may be in other shapes, and the on-off component 300 is rotatably arranged in the second chamber 102. The handle 320 may also be omitted. The slide bar 310 is pushed through an automatic control mechanism to slide in the second chamber 102.

The body portion 110 is further provided with an air outlet 112. The air outlet 112 corresponds to an end portion of the second chamber 102. The air outlet 112 and the second chamber 102 are communicated with each other. During the upward movement of the slide bar 310 from the first station 11 to the second station 12, a volume of an upper part of the second chamber 102 is reduced, and the air in an upper space of the second chamber 102 may be discharged from the air outlet 112 to prevent hindrance of pressure generated by compressed air to the sliding of the slide bar 310 and ensure the smooth pushing of the slide bar 310.

When the slide bar 310 is located at the first station 11, the slide bar 310 prevents the sensing component 500 from sensing negative pressure in the suction channel 105 to control the battery component 30 to stop heating the atomizing core 210, thereby preventing atomization of the liquid. When the slide bar 310 is located at the second station 12, the slide bar 310 enables the sensing component 500 to sense the negative pressure in the suction channel 105 to control the battery component 30 to heat the atomizing core 210, thereby starting the atomization of the liquid.

Referring to FIG. 5, FIG. 6, FIG. 9 and FIG. 10, in some embodiments, the sensing component 500 includes an airflow sensor 510. The airflow sensor 510 may be directly arranged on the battery component 30 or directly arranged on the atomization component 200. The atomization component 200 is provided with a sensing channel 513. The sensing channel 513 can be communicated with the suction channel 105. The negative pressure generated due to suction in the suction channel 105 can be sensed by the sensing component 500 through the sensing channel 513. When the slide bar 310 is located at the first station 11, the slide bar 310 closes the sensing channel 513 to hinder the sensing channel 513 from communicating with the suction channel 105. When the slide bar 310 is located at the second station 12, the slide bar 310 stops closing the sensing channel 513 to enable the sensing channel 513 to communicate with the suction channel 105. For example, the slide bar 310 is provided with a jack 312. The jack 312 may be a cylindrical hole. The base 200 of the atomization component 200 is provided with an insertion portion 511. The sensing channel 513 is provided on the insertion portion 511. The insertion portion 511 matches the jack 312 in shape, so that the insertion portion 511 can be inserted into the jack 312. A communicating port 513*a* communicated with the sensing channel 513 and the suction channel 105 is formed at a top end surface of the insertion portion 511.

When the slide bar 310 is located at the first station 11, the insertion portion 511 is inserted into the jack 312, and a bottom wall of the jack 312 blocks the communicating port 513*a*, so as to block the communication between the sensing channel 513 and the suction channel 105. When the user sucks at the nozzle, even if the negative pressure exists in the suction channel 105, the airflow sensor 510 cannot sense the negative pressure through the sensing channel 513, so that the airflow sensor 510 cannot control the battery component 30 to heat the atomizing core 210 to atomize the liquid, and the electronic atomization device 10 cannot be turned on. As a result, the user cannot suck. It is worth mentioning that since the slide bar 310 may completely block the air inlet 111 at the first station 11, an external airflow cannot enter the suction channel 105, which can also prevent the user from suction. When the slide bar 310 is located at the second position 12, the insertion portion 511 may be completely detached from the jack 312, the slide bar 310 removes the blocking of the communicating port 513*a* and the air inlet 111, and the sensing channel 513 is communicated with the suction channel 105. When the user sucks at the nozzle 131, the airflow sensor 510 senses the negative pressure in the suction channel 105 through the sensing channel 513, so as to control the battery component 30 to heat the atomizing core 210 to atomize the liquid. The smoke formed by the atomization of the liquid along with the airflow in the suction channel 105 may be sucked by the user, and the electronic atomization device 10 may be turned on to realize a suction function.

Therefore, the airflow sensor 510 senses the negative pressure in the suction channel 105 to control the electronic atomization device 10 to be turned on, which enables the electronic atomization device 10 to be sucked quickly and improves the sensitivity of the turn-on of the electronic atomization device 10.

Figure 9:
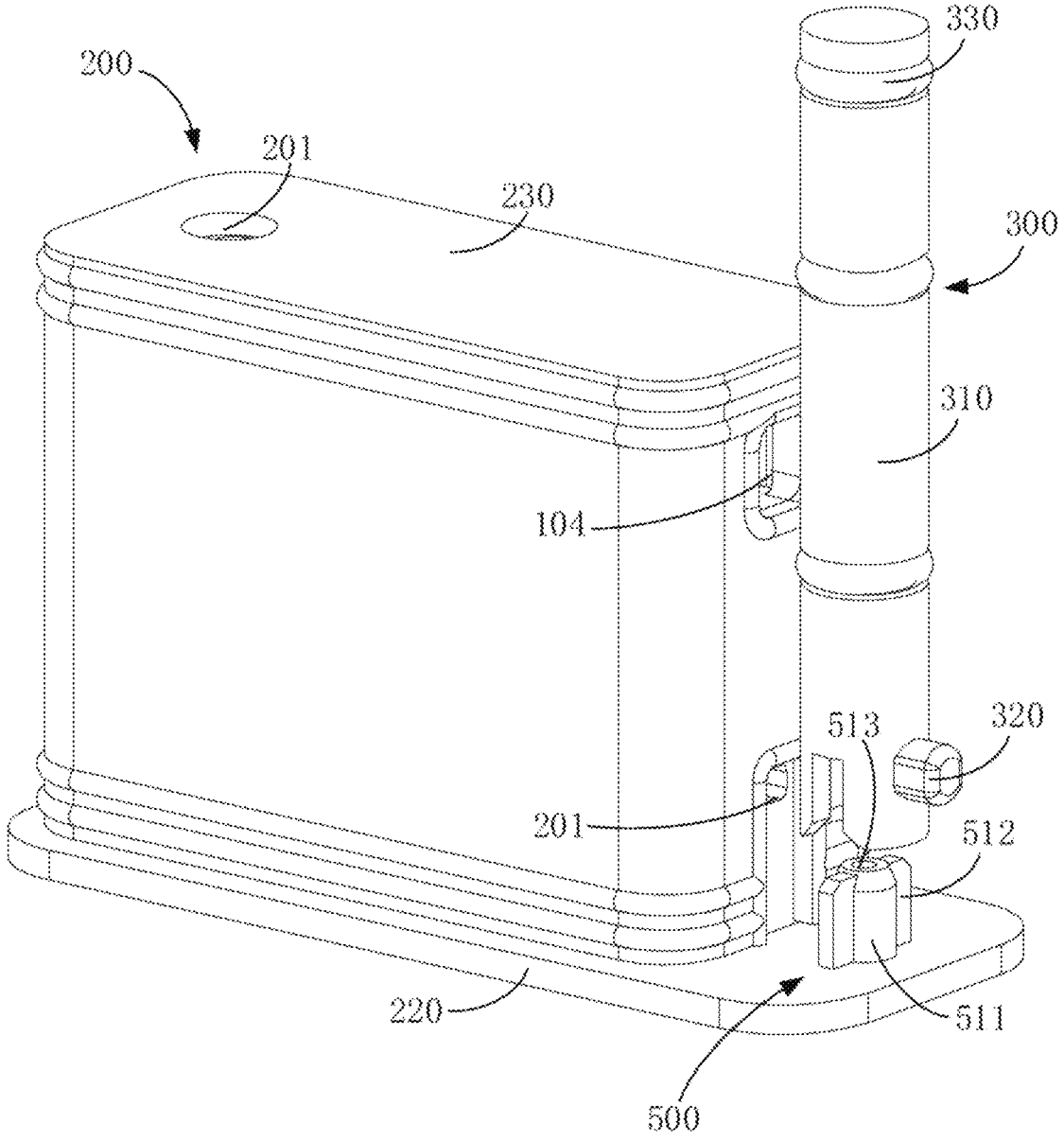
FIG. 9 is a schematic diagram of an overall assembly structure after removable of the housing in FIG. 3.
Figure 11:
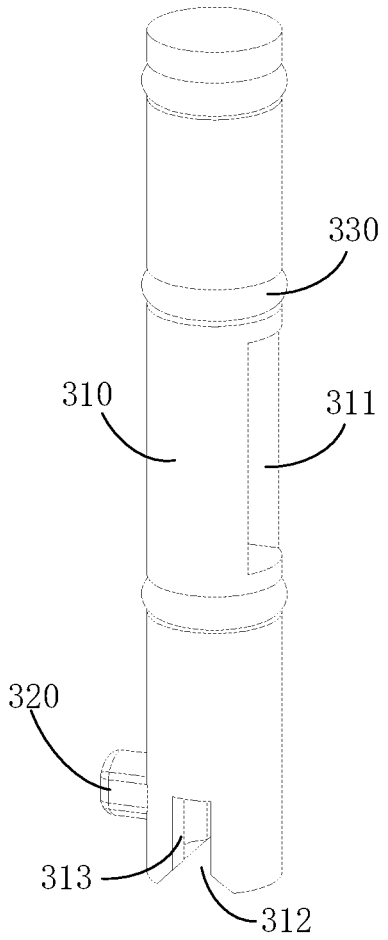
FIG. 11 is a three-dimensional view of an on-off component in FIG. 9.

Referring to FIG. 9 to FIG. 11, the slide bar 310 may be further provided with a guide groove 313. The guide groove 313 extends a set length along an axial direction of the slide bar 310. The guide groove 313 can be communicated with the jack 312 and the suction channel 105. The insertion portion 511 is provided with a guide piece 512. The guide piece 512 is substantially in a shape of a rectangle. The guide piece 512 engages with the guide groove 313. During the downward movement of the slide bar 310 from the second station 12 to the first station 11, the insertion portion 511 can smoothly engage with the jack 312 under guidance of the guide piece 512. At the same time, when the slide bar 310 leaves from the first station 11, the bottom wall of the jack 312 releases the closure of the communicating port 513*a*, so that the airflow sensor 510 can quickly and accurately sense the negative pressure in the suction channel 105 through the sensing channel 513 and the guide groove 313, which further improves the sensitivity of the electronic atomization device 10 to a suction response and ensures rapid turn-on of the electronic atomization device 10.

In some embodiments, the battery component 30 is provided with a charging interface 31. The charging interface 31 is arranged on an end portion of the battery component 30 away from the atomizer 20, that is, a bottom portion of the battery component 30. The arrangement of the charging interface 31 enables the battery component 30 to be charged at any time.

When the electronic atomization device 10 is required to be turned on for suction, firstly, the handle 320 is pushed to drive the slide bar 310 to move to the second station 12. In this case, the liquid in the liquid storage chamber 103 enters the liquid suction chamber 104 sequentially through the first through hole 121, the communicating chamber 311 and the second through hole 122. Moreover, the insertion portion 511 is detached from the jack 312 in the slide bar 310, and the sensing channel 513 is communicated with the suction channel 105. Then, the user sucks at the nozzle 131, so that negative pressure is generated in the suction channel 105. The airflow sensor 510 senses the negative pressure through the sensing channel 513 and controls the battery component 30 to heat the atomizing core 210, so as to atomize the liquid for suction.

When the electronic atomization device 10 is stopped, the handle 320 may be pushed to drive the slide bar 310 to the first station 11. In this case, the slide bar 310 blocks the first through hole 121, and the liquid in the liquid storage chamber 103 cannot flow out of the first through hole 121, so that the liquid in the liquid storage chamber 103 cannot enter the liquid suction chamber 104. At the same time, the insertion portion 511 is inserted into the jack 312 in the slide bar 310, and the slide bar 310 blocks the communicating portion 513*a* on the insertion portion 511 to hinder the sensing channel 513 from communicating with the suction channel 105. When the user sucks at the nozzle 131, even if the negative pressure exists in the suction channel 105, the airflow sensor 510 cannot sense the negative pressure through the sensing channel 513 to control the battery component 30 to heat the atomizing core 210, so that the liquid cannot be atomized for suction. Certainly, the slide bar 310 may also block the air inlet 111 completely, further preventing the user from suction.

Therefore, when the electronic atomization device 10 is in a pending state in which the user does not suck, the slide bar 310 may be located at the first station 11, so that the liquid storage chamber 103 and the liquid suction chamber 104 are isolated from each other, and there may be no large amount of liquid in the liquid suction chamber 104, so as to effectively prevent leakage of the liquid in the liquid suction chamber 104 from the atomizing core 210. At the same time, the airflow sensor 510 senses the negative pressure in the suction channel 105 to control the electronic atomization device 10 to be turned on rapidly, which improves the sensitivity of the turn-on of the electronic atomization device 10.

The technical features in the above embodiments may be randomly combined. For concise description, not all possible combinations of the technical features in the above embodiments are described. However, all the combinations of the technical features are to be considered as falling within the scope described in this specification provided that they do not conflict with each other.

The above embodiments only describe several implementations of the present disclosure, and their description is specific and detailed, but cannot therefore be understood as a limitation on the invention patent scope. It should be noted that those of ordinary skill in the art may further make variations and improvements without departing from the conception of the present disclosure, and these all fall within the protection scope of the present disclosure. Therefore, the patent protection scope of the present disclosure should be subject to the appended claims.

The invention claimed is:

1. An atomizer of an electronic atomization device, comprising:

a housing provided with a liquid storage chamber for storing liquid and a liquid outlet channel communicated with the liquid storage chamber;

an atomization component mounted on the housing, the liquid storage chamber being capable of supplying liquid to the atomization component through the liquid outlet channel; and an on-off component moveably connected to the housing and having a first station and a second station;

when the on-off component is located at the first station, the on-off component blocking the liquid outlet channel; and when the on-off component is located at the second station, the on-off component opening the liquid outlet channel;

wherein the housing comprises a body portion and an isolation portion connected to each other, the isolation portion and the body portion define a first chamber and a second chamber, the atomization component is partially received in the first chamber, and a remaining part of the first chamber except a space for receiving the atomization component forms the liquid storage chamber; and the on-off component is arranged in the second chamber; and wherein the liquid outlet channel comprises a first through hole and a second through hole spaced apart on the isolation portion, the first through hole communicates the liquid storage chamber with the second chamber, and the second through hole is communicated with the second chamber and configured to supply liquid to the atomization component; a communicating chamber is concavely formed on a surface of the on-off component; when the on-off component is located at the first station, the on-off component blocks the first through hole so that the first through hole and the second through hole are isolated from each other; and when the on-off component is located at the second station, the first through hole, the communicating chamber and the second through hole are communicated with one another.

2. The atomizer according to claim 1, wherein the on-off component slidably engages with the second chamber.

3. The atomizer according to claim 2, wherein the second chamber is a cylindrical chamber, and the on-off component comprises a cylindrical slide bar.

4. The atomizer according to claim 3, wherein the on-off component further comprises a sealing member, the sealing member being embedded into the slide bar and capable of abutting between the slide bar and an inner wall of the second chamber.

5. The atomizer according to claim 3, wherein the on-off component further comprises a handle, the handle is connected to the slide bar and configured to push the slide bar to move, the body portion is provided with an air inlet communicating the second chamber with the outside, and the handle passes through the air inlet.

6. The atomizer according to claim 5, wherein when the on-off component is located at the first station, the slide bar blocks the air inlet.

7. The atomizer according to claim 1, wherein the body portion is provided with an air outlet communicating the second chamber with the outside, and during movement of the on-off component from the first station to the second station, air in the second chamber is discharged from the air outlet.

8. The atomizer according to claim 1, wherein the atomization component is provided with a liquid suction chamber communicated with the liquid outlet channel, and the atomization component is capable of atomizing liquid in the liquid suction chamber.

9. The atomizer according to claim 8, wherein the atomization component comprises an atomizing core and is provided with a first airflow channel, the atomizing core defines a partial boundary of the liquid suction chamber and has an atomizing surface capable of atomizing liquid, the first airflow channel passes through the atomizing surface, and the atomizing core defines a surface of the boundary of the liquid suction chamber to be recessed toward the atomizing surface to form a buffer chamber communicated with the liquid suction chamber.

10. The atomizer according to claim 9, wherein a size of a cross section of the buffer chamber decreases along a direction of the liquid suction chamber pointing to the first airflow channel.

11. The atomizer according to claim 8, wherein the atomization component further comprises a base and a top cover connected to each other, the atomizing core and the top cover define the liquid suction chamber, the base is provided with a first step surface, the top cover is provided with a second step surface arranged opposite to the first step surface, and the atomizing core is sandwiched between the first step surface and the second step surface.

12. The atomizer according to claim 11, wherein the atomization component further comprises a silicon gel sleeve, the atomizing core is sleeved with the silicon gel sleeve and the silicon gel sleeve abuts between the first step surface and the second step surface.

13. The atomizer according to claim 1, wherein the housing comprises a nozzle portion, the atomization component is provided with the first airflow channel, the nozzle portion is partially received in the liquid storage chamber and provided with a second airflow channel communicated with the outside, and the nozzle portion is inserted into the atomization component and communicates the second airflow channel with the first airflow channel.

14. The atomizer according to claim 1, further comprising a cap mounted on the housing, the housing being further provided with a liquid injection hole communicating the liquid storage chamber with the outside, and the cap being capable of sealing the liquid injection hole.

15. The atomizer according to claim 1, wherein the electronic atomization device comprises a sensing component, the housing and the atomization component are each provided with a suction channel communicated with the outside, the atomization component is provided with a sensing channel capable of being communicated with the suction channel, and negative pressure in the suction channel is sensed by the sensing component through the sensing channel; and when the on-off component is located at the first station, the on-off component closes the sensing channel to isolate the suction channel from the sensing channel, and the sensing component stops sensing the negative pressure in the suction channel; and when the on-off component is located at the second station, the sensing channel is communicated with the suction channel, and the sensing component is capable of sensing the negative pressure in the suction channel.

16. An electronic atomization device, comprising a battery component, a sensing component, and the atomizer according to claim 1, the battery component being connected to the atomizer.

17. The electronic atomization device according to claim 16, wherein the sensing component comprises an airflow sensor, the airflow sensor being arranged on the battery component or the atomizer.

18. The electronic atomization device according to claim 16, wherein an end portion of the battery component away from the atomizer is provided with a charging interface for charging.

* * * * *